US009650759B2

(12) United States Patent
Dolan

(10) Patent No.: US 9,650,759 B2
(45) Date of Patent: May 16, 2017

(54) CONTROL APPARATUS FOR HYDRAULIC HEAVY MACHINERY

(71) Applicant: Francis Dolan, Ballinasloe (IE)

(72) Inventor: Francis Dolan, Ballinasloe (IE)

( * ) Notice: Subject to any disclaimer, the term of this patent is extended or adjusted under 35 U.S.C. 154(b) by 0 days.

(21) Appl. No.: 15/107,460

(22) PCT Filed: Dec. 23, 2014

(86) PCT No.: PCT/EP2014/079243
§ 371 (c)(1),
(2) Date: Jun. 22, 2016

(87) PCT Pub. No.: WO2015/097247
PCT Pub. Date: Jul. 2, 2015

(65) Prior Publication Data

US 2016/0319514 A1 Nov. 3, 2016

(30) Foreign Application Priority Data

Dec. 23, 2013 (GB) ..... 1322928.1

(51) Int. Cl.
*E02F 9/20* (2006.01)
*E02F 9/22* (2006.01)
*E02F 9/08* (2006.01)

(52) U.S. Cl.
CPC ..... *E02F 9/205* (2013.01); *E02F 9/0883* (2013.01); *E02F 9/2004* (2013.01); (Continued)

(58) Field of Classification Search
CPC ..... E02F 9/205; E02F 9/2235; E02F 9/2004; E02F 9/2225; E02F 9/2228; E02F 9/0883; E02F 9/2066; E02F 9/2267; E02F 9/2296
See application file for complete search history.

(56) References Cited

U.S. PATENT DOCUMENTS 3,933,081 A 1/1976 Taki et al.
4,776,750 A 10/1988 Griswold et al.
(Continued)

*Primary Examiner* — Rodney Butler
(74) *Attorney, Agent, or Firm* — LaMorte & Associates, P.C.

(57) ABSTRACT

The present invention relates to a control apparatus for a hydraulic machine comprising: a remote control unit, a valve arrangement for activation means of the remote control unit, each valve arrangement comprising a first valve means in fluid communication with a second valve means; a controller means operable to control the opening and closing of the first valve means of the associated valve arrangement to regulate the flow of hydraulic fluid from the first valve means to the second valve means, wherein, the second valve means in each valve arrangement is moved between first and second configurations to enable the functions of the hydraulic machine to switch between remote control mode and cab control mode when the conditions dictate that it may no longer be practical or safe for a user to remain in the cab. The invention also relates to a method of fitting the control apparatus to a hydraulic machine, and to an interface harness for connecting the control apparatus to such a hydraulic machine. Once the control apparatus is fitted the hydraulic machine may be operated in either manual or remote mode. When the conditions that necessitated the use of remote operation have passed the operator may return to the cab and operate the machine again as a standard machine.

20 Claims, 5 Drawing Sheets

(52) U.S. Cl.
CPC ..... *E02F 9/2066* (2013.01); *E02F 9/2225* (2013.01); *E02F 9/2228* (2013.01); *E02F 9/2235* (2013.01); *E02F 9/2267* (2013.01); *E02F 9/2296* (2013.01)

(56) References Cited

U.S. PATENT DOCUMENTS

| | | | | |
|---|---|---|---|---|
| 6,691,435 | B1 * | 2/2004 | Schultz | E01H 5/06 172/2 |
| 6,836,982 | B1 | 1/2005 | Augustine | |
| 8,272,467 | B1 | 9/2012 | Staab | |
| 2003/0147727 | A1 | 8/2003 | Fujishima et al. | |
| 2009/0322519 | A1 | 12/2009 | Torres | |
| 2014/0067176 | A1 * | 3/2014 | Goto | E02F 9/2075 701/22 |
| 2016/0010310 | A1 * | 1/2016 | Schmidt | E02F 3/325 701/2 |

* cited by examiner

CONTROL APPARATUS FOR HYDRAULIC HEAVY MACHINERY

The present invention relates to a control apparatus for heavy machinery, such as, but not limited to, hydraulic machines, including excavators, bulldozers, dumpers and other hydraulic equipment and to a method of fitting the control apparatus to a hydraulic machine. The invention also relates to an interface harness for connecting the control apparatus to a hydraulic machine.

The operators of hydraulic equipment, often encounter conditions that render the use of such machines impossible or unsafe. Examples of frequently encountered dangers include the potential risk of material falling on the equipment causing damage to the machine and harm to the operator, and also exposure of the operator to fumes or gases in the vicinity of the work zone.

The only current solution when these situations arise is to utilise a purpose built machine or robot and there are currently a number of purpose built radio remote control robots on the market. However, these purpose built machines have no facility to operate manually, and moreover, they are very expensive and are generally only operated by specialist companies.

Accordingly, when operators of standard excavators encounter such unsafe conditions or tasks which are not possible to be performed they are typically required to withdraw their own equipment and staff from a work zone and commission such specialist companies with trained staff to operate robots for the purpose of performing the required tasks.

Such a requirement is unsatisfactory as it adds considerably to the costs of performing a task and results in financial loses for operators due to the downtime associated with the withdrawal of their own equipment and staff.

It is a therefore an object of the present invention to provide a control apparatus which goes at least some way toward overcoming the above problems and for which will provide the public and/or industry with a useful alternative.

Further aspects of the present invention will become apparent from the ensuing description which is given by way of example only.

According to the invention, there is provided a control apparatus for hydraulic machinery of the type comprising a main servo control block, a hydraulic fluid holding tank and a cab control system having a plurality of controls for activating functions of the hydraulic machinery, the apparatus comprising:

- a remote control unit comprising a plurality of activation means in which each activation means is operable when activated to control a function of the hydraulic machinery corresponding to a control of the cab control system,
- a valve arrangement for each activation means, each valve arrangement comprising a first valve means in fluid communication with a second valve means;
- a controller means operable in response to signals received from an activation means of the remote control unit to control the opening and closing of the first valve means of the associated valve arrangement to regulate the flow of hydraulic fluid from the first valve means to the second valve means for that valve arrangement;
- wherein, the second valve means in each valve arrangement is moved between first and second configurations, in which in the first configuration the associated first valve means is open to permit the flow of hydraulic fluid through the first valve means to the second valve means and the second valve means is operable to channel the hydraulic fluid received from the first valve means to the main servo control block to control the function of the hydraulic machinery corresponding to the activated activation means of the remote control unit, and in the second configuration the associated first valve means is closed preventing the flow of hydraulic fluid through the first valve means to the second valve means such that the second valve means is operable to instead channel hydraulic fluid from the cab control system to the main servo control block to control the function of the hydraulic machinery corresponding to the activated control of the cab control system.

In another embodiment of the invention, in which hydraulic fluid only flows from one of the first valve means and the cab control system to the second valve means at any given time.

In another embodiment of the invention, each first valve means is operable to receive hydraulic fluid from the fluid holding tank of the hydraulic machinery.

In another embodiment of the invention, each second valve means of each valve arrangement is connected to the first valve means and the cab control system of the hydraulic machinery.

In another embodiment of the invention, the remote control unit is a hand-held portable device.

In another embodiment of the invention, the remote control unit comprises a radio frequency transmitter and the signals from the activation means of the remote control unit machine are transmitted as radio frequency signals.

In another embodiment of the invention, each activation means when activated generates machine control signals for transmission to the controller means, whereby the controller means is operable to convert the machine control signals into valve control signals for controlling the opening and closing of the first valve means.

In another embodiment of the invention, the first valve means for each valve arrangement is housed within a hydraulic manifold block.

In another embodiment of the invention, the hydraulic manifold block is supported on a frame mounted on the hydraulic machinery.

In another embodiment of the invention, the first valve means of each valve arrangement comprises a proportional solenoid valve.

In another embodiment of the invention, signals transmitted by the controller means are variable voltage output signals operable to activate and control the flow of fluid through the proportional solenoid valve.

In another embodiment of the invention, the controller means is connected to the hydraulic manifold block on the frame and the controller means is mounted on vibration absorbing means, such as rubber mounts, on the frame.

In another embodiment of the invention, the fluid holding tank is coupled to a main hydraulic pump and a pilot pump, and the pilot pump is operable to pump fluid from the fluid holding tank to the first valve means.

In another embodiment of the invention, the second valve means is a shuttle valve comprising first and second fluid inlet ports, a pivoting valve member and a fluid outlet port, and in which the first valve means is coupled to one of: the first inlet port and the second inlet port, and the cab control system is coupled to the other of the: first inlet port and the second inlet port, and the main servo control block is coupled to the outlet port, whereby the force of hydraulic fluid flowing through one of: the first inlet port and second inlet port causes the valve member to pivot and close the other of: the first inlet port and second inlet port so that hydraulic fluid flows through the fluid outlet port to the main servo control block from one of the first valve means and the cab control system at any given time.

Accordingly, it will be understood that for each valve arrangement, the first valve means connects to one fluid inlet port of the shuttle valve, the cab control system connects to the other fluid inlet port of the shuttle valve, and the main servo control block of the hydraulic machine is connected to the fluid outlet port of the shuttle valve.

In another embodiment of the invention, the shuttle valve is connected to the first valve means, the cab control system and the main servo control block using fluid supply conduits or hoses.

In another embodiment of the invention, the control apparatus further comprises an interface harness operable to connect the apparatus to the hydraulic machinery.

In another embodiment of the invention, the interface harness comprises an electrical power supply cable operable to connect the controller means of the control apparatus to the power supply means of the hydraulic machinery for the supply of power to the controller means.

In another embodiment of the invention, the interface harness further comprises hydraulic fluid supply lines, in which a hydraulic fluid supply line provided is operable to connect the first valve means of a valve arrangement for a function of the hydraulic machinery to one of the fluid inlet ports of the second valve means of the valve arrangement, and a further fluid supply line is operable to connect the cab control system of the hydraulic machinery corresponding to the function of the hydraulic machinery to the other fluid inlet port of the second valve means.

In another embodiment of the invention, the second valve means for a valve arrangement for a function of the hydraulic machinery is coupled intermediate the first valve means and the cab control system.

Preferably, each hydraulic fluid supply line of the interface harness comprises a free end having fixtures for fitting the interface harness to the pilot hose outlet of the cab control system of the specific hydraulic machinery.

In another embodiment of the invention, the electrical power supply cable and hydraulic fluid supply lines of the interface harness are covered in a protective sleeve.

In a further embodiment, the present invention relates to a method of fitting a control apparatus as claimed to a hydraulic machine, in which the second valve means is a shuttle valve comprising first and second fluid inlet ports, a pivoting valve member and a fluid outlet port, the method comprising steps of:

- disconnecting an individual pilot servo hose from a pilot hose outlet of the cab control system of the hydraulic machinery for a function of the hydraulic machinery;
- connecting the pilot hose outlet from which the pilot servo hose was disconnected to one of: the first fluid inlet port and the second fluid inlet port of the shuttle valve;
- connecting the first valve means to the other of: the first fluid inlet port and the second fluid inlet port of the shuttle valve;
- connecting the pilot servo hose that was disconnected from the pilot hose outlet to the fluid outlet port of the shuttle valve to thereby connect the first valve means and the cab control system to the main servo control block via the shuttle valve to complete the fitting for the function of the hydraulic machinery to thereby adapt the hydraulic machine for dual control so that a function of the hydraulic machine is controllable by or from the cab control system or the remote control unit.

Preferably, the method of fitting the control apparatus comprises a step of: repeating the above steps performed for a plurality of functions of the hydraulic machinery.

The present invention enables a user to switch total operation, including all functions, and/or only specific functions, of a hydraulic machine between remote control mode and cab control mode when the conditions of use dictate that it may no longer be practical or safe for a user to remain in the cab. Once the control apparatus is fitted the hydraulic machine may be operated in either manual or remote mode. When the conditions that necessitated the use of remote operation have passed the operator may return to the cab and operate the machine again from the cab controls.

The control apparatus can be fitted to most hydraulic machines, such as excavators. It is a purpose built unit that interfaces with the machines own hydraulic servo control system to facilitate dual control of the machines so that control from the traditional in cab controls may be transferred to a remote controller through a purpose built manifold block and arrangement of shuttle valves to the remote system. This manifold block is controlled by a series of proportional pressure reducing solenoid valves which in turn are activated via radio remote control. The remote control is configured to mimic the layout of the cab based controls of the host machine. The control apparatus is designed using hoses and fittings matching those used by the original equipment manufactures. The control apparatus can be fitted without the need for any expensive workshop equipment and can be fitted on site. The system can be removed again if desired to move to a different machine.

The invention will be more clearly understood from the following description of some embodiments thereof, given by way of example only, with reference to the accompanying drawings, in which.

Figure 1:
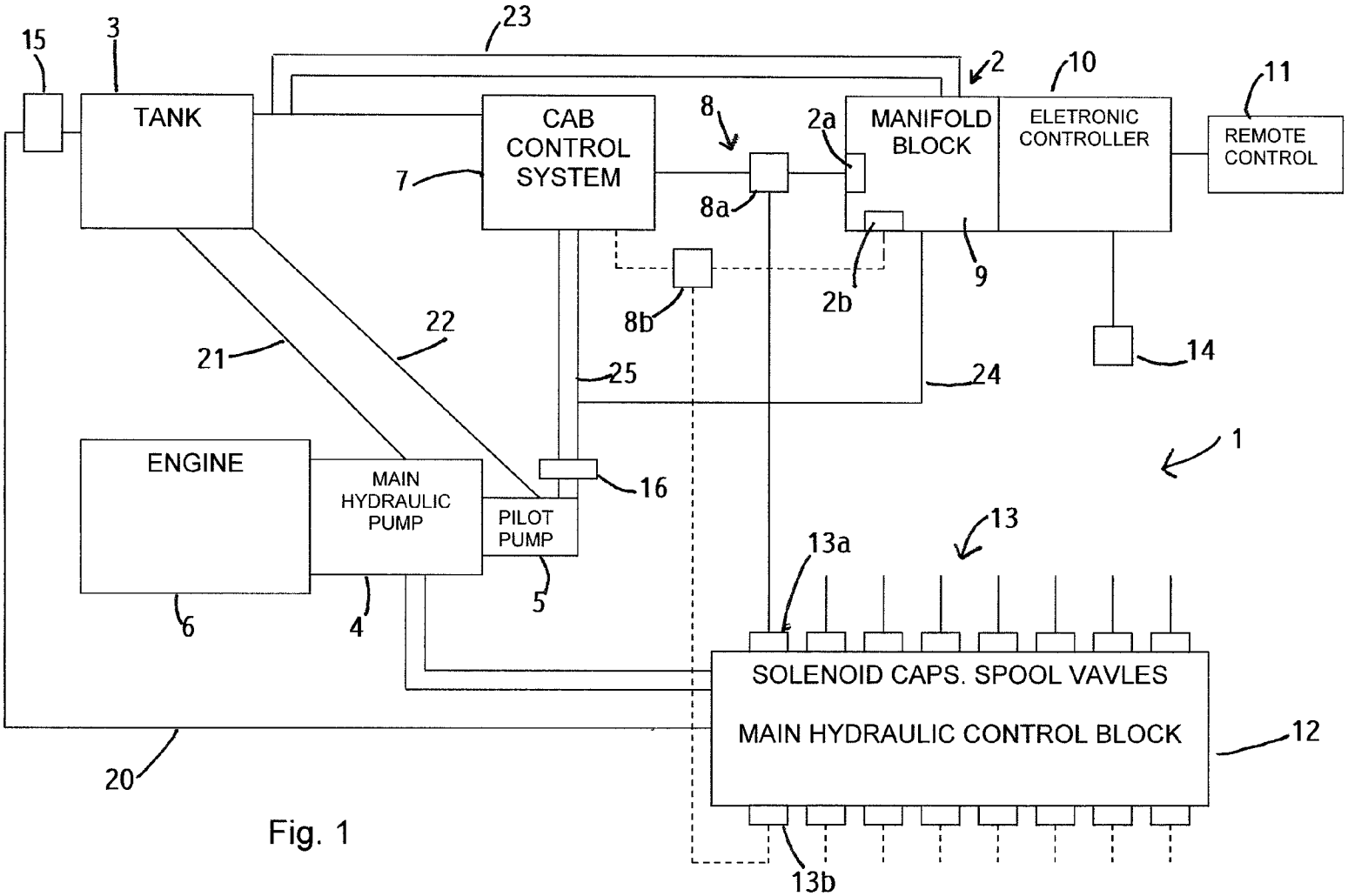
FIG. 1 is a block schematic showing a control apparatus according to the invention.
Figure 2:
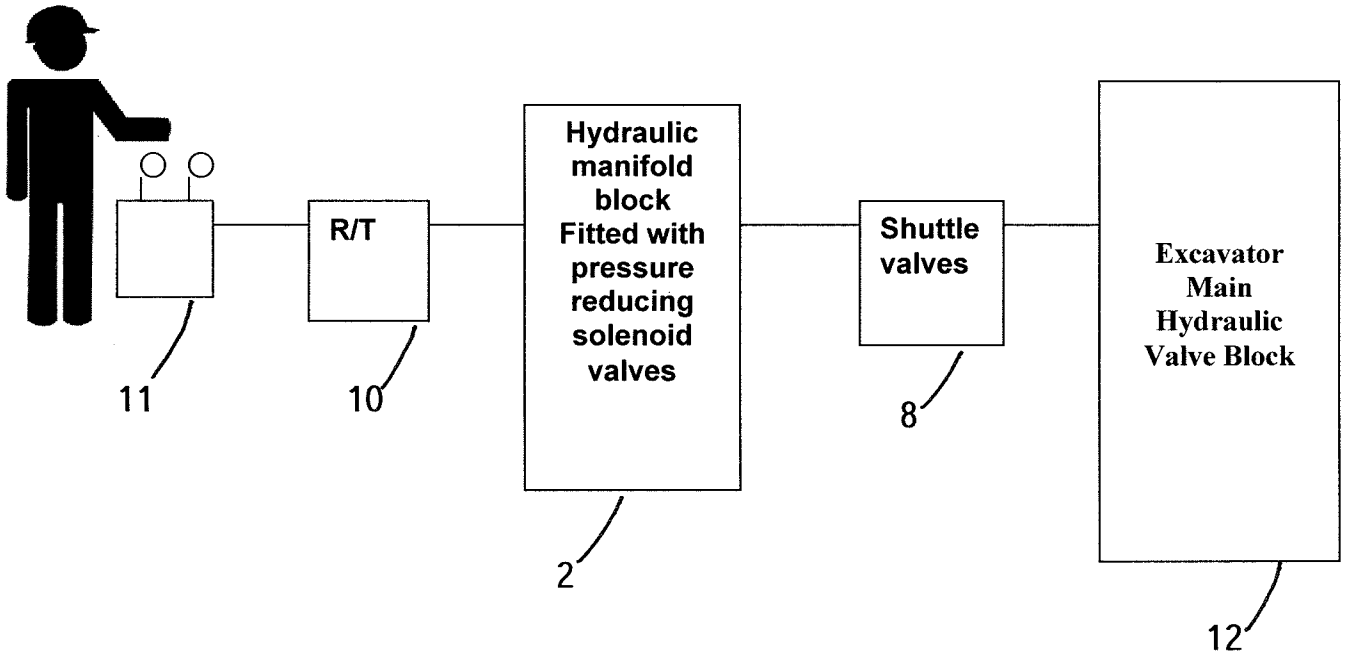
FIG. 2 is a stylised schematic showing components of the control apparatus shown in FIG. 1.
Figure 3:
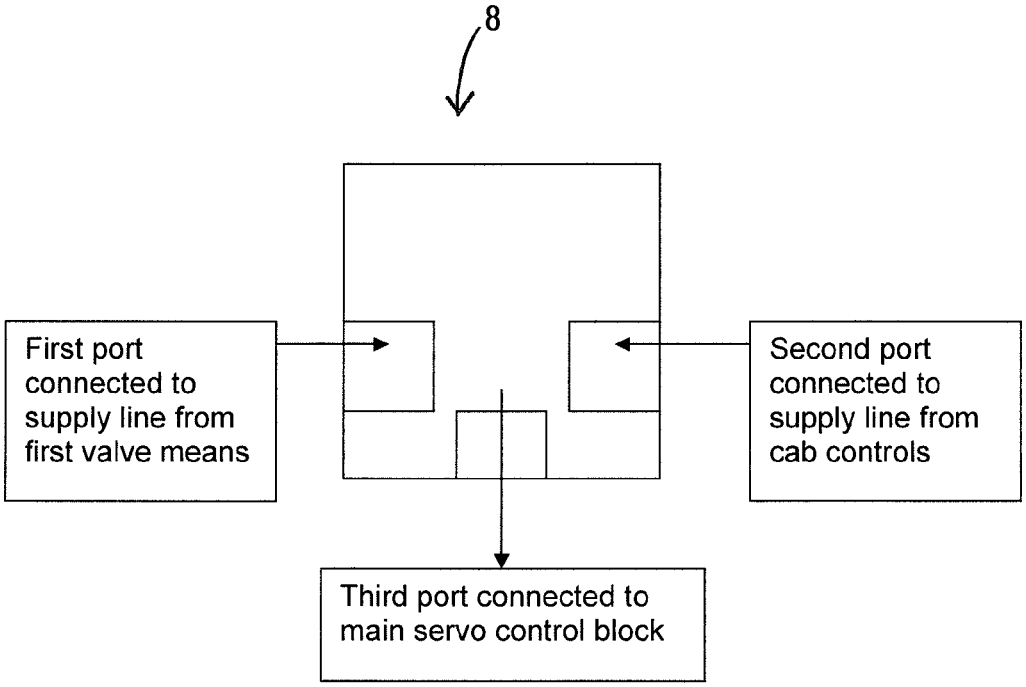
FIG. 3 is a block schematic of a second valve means according to the invention.

Referring to the drawings, and initially to FIGS. 1 to 3, there is shown a control apparatus, indicated generally by the reference numeral 1, for hydraulic machinery comprising a valve arrangement for each function of the hydraulic machinery.

Each valve arrangement comprises first valve means 2 operable to receive fluid from a main fluid holding tank 3 of the hydraulic machinery. The fluid holding tank means 3 is coupled to a main hydraulic pump 4 and a pilot pump 5 of the hydraulic machinery to circulate the hydraulic fluid through supply pipe work or lines of the hydraulic machinery and the control apparatus 1 of the present invention. The main hydraulic pump 4 is coupled to the engine 6 of the hydraulic machinery. In the instance shown, the pilot pump 5 is operable to pump hydraulic fluid from the fluid holding tank 3 to the first valve means 2 of the control apparatus 1 and the cab control system, indicated generally by the reference numeral 7, of the hydraulic machinery.

Figure 4:
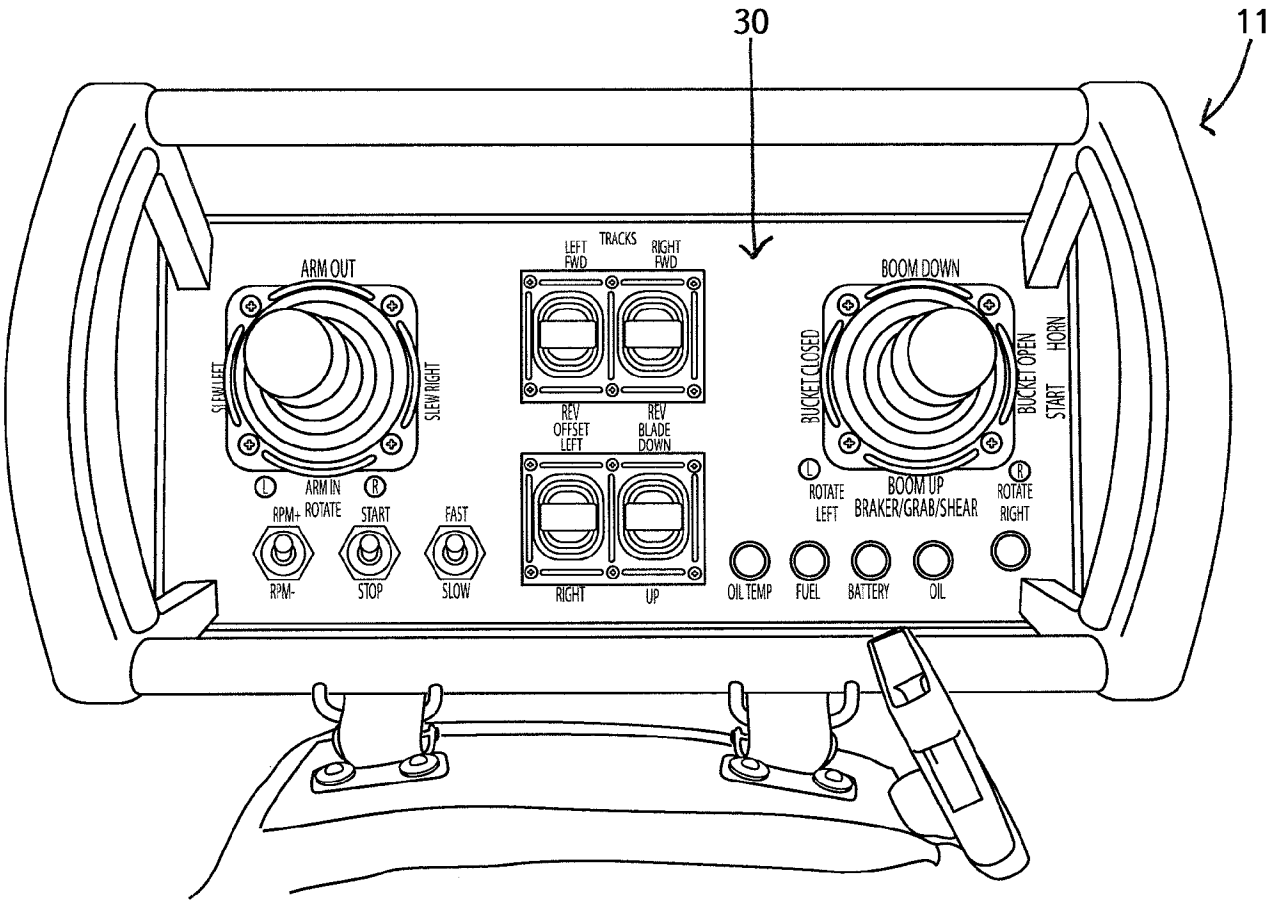
FIG. 4 is stylised plan view of a remote control unit according to the invention.

Shown in FIG. 4 is a remote control unit 11, which provides a range of activation means, indicating generally by the reference numeral 30, such as actuators, levers, toggles, thumb controls and/or buttons, which correspond to controls of the cab control system 7 of the hydraulic machinery. For example, the remote control unit 11 may have controls and activation means corresponding to the following functions of the cab control system 7 of hydraulic machinery, including but not limited to boom up, boom down, arm in, arm out, slew left, slew right, bucket open, bucket close, left track forward, left track back, blade up, blade down, right track forward, right track back, offset arm left, offset arm right, breaker/muncher/grapple open, breaker/muncher/grapple close, rotation left, rotation right.

The remote control unit 11 is operable to convert inputs received from a user operator to hydraulic machinery control signals which are then transmitted to electronic controller means 10, which in turn converts those signals into variable voltage output signals for transmission to the first valve means 2. The remote control unit is optionally a hand-held portable device and comprises a radio frequency transmitter so that the hydraulic machinery control signals are transmitted as radio frequency (RF) signals to the controller means 10.

The controller means 10 is powered by the battery 14 of the hydraulic machinery and comprises an electronic signalling transceiver and is operable to transmit valve control signals to the first valve means 2 in order to regulate and control the flow of hydraulic fluid through the first valve means 2. The valve control signals are transmitted by the controller means 10 as variable voltage output signals to activate and control the flow of hydraulic fluid through the first valve means 2.

The first valve means 2 of each valve arrangement comprises a proportional solenoid valve. In FIG. 1, proportional solenoid valves 2*a*, 2*b* (hereinafter referred to collectively as proportional solenoid valves 2) are shown for exemplary purposes, in which each proportional solenoid valve 2 corresponds to a working function of the hydraulic machinery. The number of proportional solenoid valves in use will depend on the number of functions of the hydraulic machinery which are to be performed by the control apparatus. Reference only to proportional solenoid valves 2*a*, 2*b* should therefore in no way be seen as limiting. It will also be understood that other forms of hydraulic valve may also be used to provide first valve means of the present invention and reference to proportional solenoid valves should not be seen as limiting.

The proportional solenoid valves 2 are housed within a hydraulic manifold block 9, which is supported on a frame mounted to the hydraulic machinery. The controller means 10 is electrically coupled to the hydraulic manifold block 9 and connected on the frame and mounted on vibration absorbing means, such as rubber mounts.

Each valve arrangement further comprises second valve means, indicated generally by the reference numeral 8, connected via fluid supply lines to the first valve means 2. The second valve means 8 each comprise at least one shuttle valve 8. In FIG. 1, shuttle valves 8*a*, 8*b* (hereinafter referred to collectively as shuttle valves 8) are shown for exemplary purposes and reference only to shuttle valves 8*a*, 8*b* only should therefore in no way be seen as limiting. In practice, each valve arrangement of the control apparatus 1 corresponds to a function of the hydraulic machine, and each valve arrangement comprises a first valve means 2 and second valve means 8 combination.

It will be understood that the control apparatus 1 comprises a valve arrangement for each function of the hydraulic machine that is activated or adapted to be activated by user interaction with the various activation means of the remote control unit, and each valve arrangement comprises a first valve means in fluid communication with a second valve means.

It will be understood that a separate shuttle valve 8 is coupled to each supply line from a corresponding proportional solenoid valve 2. Thus proportional solenoid valve 2*a* is connected by a fluid supply line to shuttle valve 8*a*, proportional solenoid valve 2*b* is connected by a fluid supply line to shuttle valve 8*b* and so on.

Each shuttle valve 8 comprises three ports, in which a first inlet port is coupled to a fluid supply conduit from a proportional solenoid valve 2, a second inlet port is coupled to a fluid supply conduit or pilot line from the cab control system 7 and a third outlet port is coupled to a fluid supply conduit connected to a spool valve or solenoid caps, indicated generally by the reference numeral 13 of a main servo control block 12 of the hydraulic machinery. As shown, the supply line from shuttle valve 8*a* is coupled to spool valve 13*a* and the supply line from shuttle valve 8*b* is coupled to spool valve 13*b* of the main servo control block 12. Couplings on the main hydraulic control block 12 for connection to additional shuttle valves which are required are also shown.

In operation, the second valve means 8 is moveable between a first configuration in which the hydraulic fluid flowing through the first valve means 2 is channelled through the second valve means 8 to the main servo control block to activate a function of the hydraulic machinery, and a second configuration in which hydraulic fluid from a cab control system 7 of the hydraulic machinery flows through the second valve means 8 to the main servo control block to activate at least one function of the hydraulic machinery.

The first configuration is activated when fluid flows into the second valve means 8 from the first valve means 2, and the second configuration is activated when fluid flows into the second valve means 8 from the cab control system 7. It will be understood that fluid only flows to the second valve means 8 from one of: the first valve means 2 and the cab control system at any given time 7.

The first configuration is thus activated by operators switching to remote operation of the hydraulic machinery and interacting with the remote control unit 11 which sends hydraulic machinery control signals encoding the performance of a function of the hydraulic machinery, such as boom up, boom down, cab swivel etc. In this remote operation mode, hydraulic fluid is permitted to flow through supply lines to the proportional solenoid valves 2 of the first valve means 2 for the desired function under the control of the controller means 10. From the proportional solenoid valve 2 the hydraulic fluid flows through the first port of the associated shuttle valve 8 which in turn moves the shuttle valve 2 to close off the second port connected to the fluid supply conduit or pilot line from the cab control system 7 so that hydraulic fluid is channelled through the shuttle valve to the associated spool valve or solenoid cap 13 on the main servo control block 12 to activate the desired function of the hydraulic machinery.

Conversely, when remote operation is no longer required control is passed back to the cab control system 7 which corresponds to the second configuration of the present invention. In this in-cab mode of operation hydraulic fluid flows from supply pipe work of the cab control system 7 for the desired function of the hydraulic machinery and through the second port of the associated shuttle valve 8 which in turn moves the shuttle valve 2 to close off the first port so that the hydraulic fluid is channelled through the shuttle valve to the associated spool valve or solenoid cap 13 on the main servo control block 12 to activate the desired function of the hydraulic machinery from the cab control system 7.

This present invention enables the operator of a hydraulic machine or other hydraulic equipment to switch to remote control mode when the conditions dictate that it may no longer be practical or safe to remain in the cab. Once the system is fitted to a hydraulic machine the machine can be operated in either manual mode from the cab control system 7 or in remote mode from the remote control unit 11. When the conditions that necessitated the use of remote operation have passed the operator may return to the cab and operate the machine again as a standard hydraulic machine.

The system can be fitted to most modern hydraulic machine. It is a purpose built unit that interfaces with the hydraulic machines own hydraulic servo control system and transfers control when in remote mode from the traditional in cab controls through a purpose built manifold block 9 to the remote system. This manifold block 9 is controlled by a series of proportional pressure reducing solenoid valves which in turn are activated via radio remote control from the remote control unit 11. The remote control unit 11 has controllers which are configured to mimic the layout of the cab based controls.

Also shown in FIG. 1 is supply line 20 which provides a return conduit for hydraulic fluid from the main servo control block 12 back to the tank 3 via filter 15; oil feed line 21 from the tank to the main hydraulic pump; oil feed line 22 from the tank 3 to the pilot pump; a high pressure fluid supply line from the main hydraulic pump to the main hydraulic control block 12; a fluid return line 23 from the manifold block 9 to the tank 3; a fluid supply line 24 which is connected to the manifold block 9 from the the main servo line 25 linking the pilot pump 5 to the cab control system 7; a filter 16 is positioned between the pilot pump 5 and cab control system 7 on supply line 25.

Figure 5:
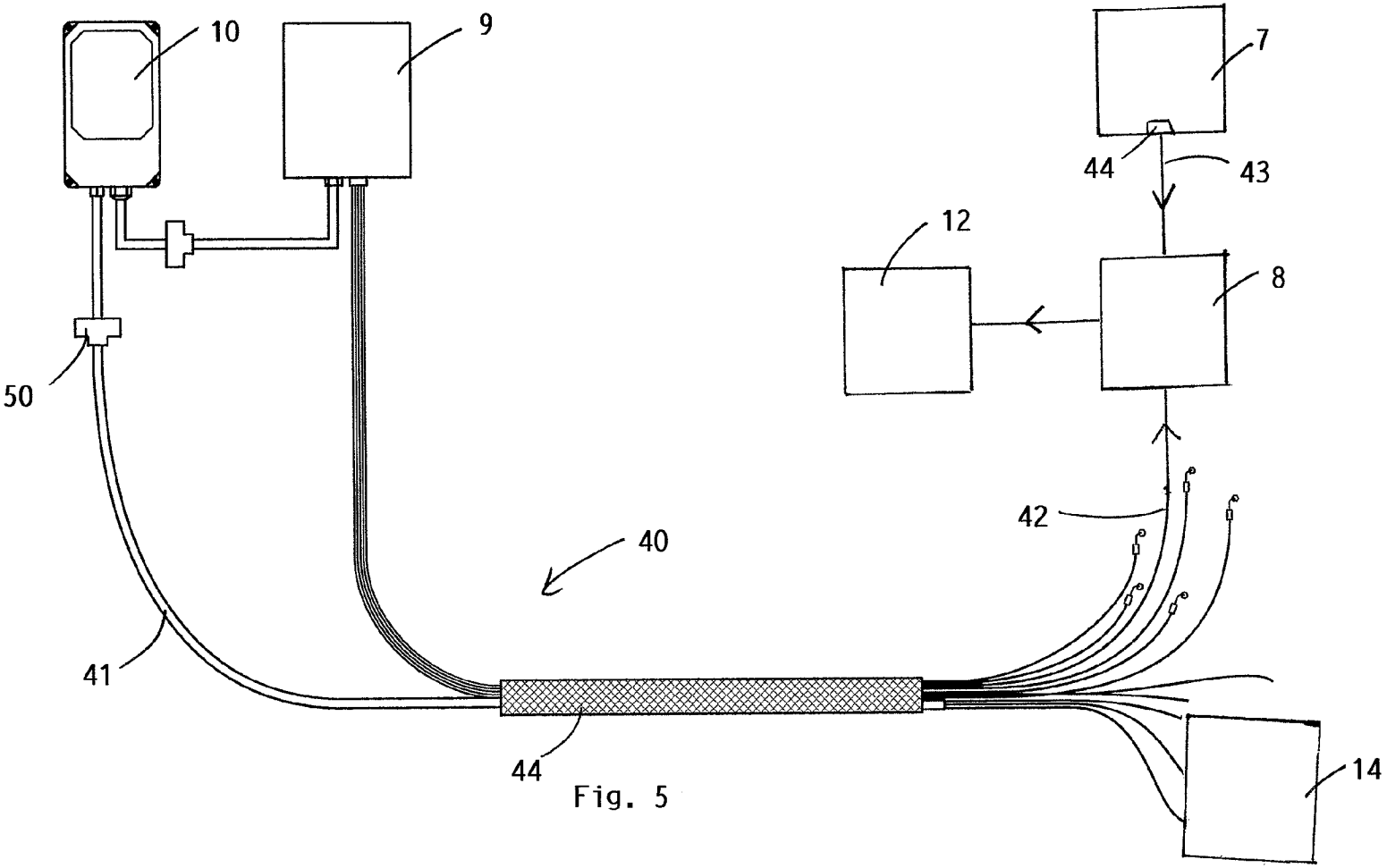
FIG. 5 is a schematic of an interface harness operable to enable installation of the control apparatus to a hydraulic machine according to the invention.

Shown in FIG. 5 is an interface harness 40 operable to connect the control apparatus 1 to a specific hydraulic machine, which may be, for example, Hitachi®, Komatsu®, Catherpillar® or like hydraulic machines.

The interface harness 40 comprises an electrical power supply cable 41 operable to connect, via a connector 50, the controller means 10 of the apparatus 1 to the power supply means 14 (see FIG. 1) of the hydraulic machine for the supply of power to the controller means 10. The electrical cable 41 is operable to transfer 12V or 24V power from the hydraulic machine to the controller means 10. This electrical cable 41 also transfers commands to the hydraulic machine's engine 6 (see FIG. 1), such as throttle power, machine conditions, warnings, and operating parameters and indicators which may be displayed on the remote control unit 11, such as oil, temperature, battery power, fuel levels and the like.

The interface harness 40 further comprises a hydraulic fluid supply line 42 for connecting each first valve means 2, which is provided as a proportional solenoid valve in the hydraulic manifold 9, to a fluid inlet of a shuttle valve 8 for each valve arrangement. A further hydraulic fluid supply line 43 is provided with the interface harness 40 to couple the other fluid inlet of the shuttle valve 8 to an outlet of the cab control system 7 corresponding to a function of the hydraulic machine. End fixtures 44 of each the hydraulic fluid supply lines 43 are selected so that they are each operable to match with, and so connect with, an outlet of the cab control system 7 for a specific machine type.

The interface harness 40 may optionally include the respective shuttle valve 8 for each valve arrangement in an inline arrangement.

The electrical power supply cable 41 and hydraulic fluid supply lines 42 of the interface harness are covered in a sleeve 44.

In practice, the interface harness 40 enables the control apparatus to be fitted to a particular hydraulic machine type. The hydraulic fluid supply lines 43 are cut to a desired length for the machine type and provided with appropriate fittings depending on the cab control system 7 of the specific machine type. The fluid lines 42 are fitted through the sleeve 44 with one end connecting to a first valve means 2 in the manifold block 9, and the other end to an inlet port of the shuttle valve 8.

The present invention is thus designed using hoses and fittings that are configured to match those used by the original equipment manufacturers. The system can be fitted without the need for any expensive workshop equipment and may be fitted on site. The system can be removed again if desired to move to a different machine.

The control unit consists of the hydraulic manifold block and electronic receiver unit housed in a small housing secured to the machine bonnet or indeed at any point on the machine. This box comes completely pre-wired and plumbed and is standard to all machine types. It is completely enclosed in a steel surround for durability and protection. For fitting purposes it is simply secured to the machine. Electrical power for the unit is taken from the machine itself either 12 or 24 volts. The machines safety and warning systems are relayed to the remote control via data feed back ensuring the operator is at all times in command and informed of potential engine or machine malfunctions.

Also provided are a set of attachments including brackets and fittings to enable the housing to be fitted to a particular type and model of machine. It will be supplied to match the machine type and model. Therefore the present invention is transferable to any machine and will require the attachments to transfer to a different make or model. Electrical power for the control unit is taken from the machine electrical system either 12 or 24 volts. The appropriate cables and connectors for a particular make and model of machine specified are supplied. As with the electronics the appropriate hydraulic hoses and connectors to complete the fitting are also supplied in this kit.

The present invention will enable a machine to which it is integrated to have the ability to operate as a standard machine whilst also having the capacity to carry out the duties of a purpose built robotic machine, which previously necessitated the use of two different machines to carry out these various duties.

The present invention has huge capacity and scope for industrial application, including, but not limited to works involving demolition where a real risk of debris or building collapse create a situation where it is unsafe for an operator to remain in the cab; works at leading edges where it is not permissible to operate machinery in conventional manner due to health and safety rules and regulations; working in areas where fumes or gases are present necessitating the removal of the operator to a safe distance; works involving the removal of land mines or unexploded munitions creating a complete new area of operations whereby the operator can operate remotely and out of the danger area; de-scaling of kilns in plants such as cement factories; works involving the use of an excavator as a crane allowing the driver to work remotely thus allowing line of sight for placing objects/loads etc; works involving the clearance of chambers or headings where it is not possible for the operator to observe the works from the machine cab; use by emergencies services in the recovery and investigation of disaster zones, and situations where for any reason it is safer or more practical for the operator to work remotely.

The present invention interfaces with the machines servo hydraulic system and includes:

Mounting Frame: Bolted to machine body or any location on machine supports hydraulic manifold block and electronic controller. Electronic Controller: Receives signal from radio remote control and delivers commands to proportional solenoid valves. Hydraulic manifold block with proportional solenoid valves installed. Radio Remote Control Transmitter: Hand held unit sends signal to machine mounted controller. Shuttle Valves: Directs hydraulic flow from either in cab controls or remote control system to operate spools in machine main control block via the shuttle valves.

The electronic controller receives radio signals from the hand held transmitter and transfers these signals via variable voltage output to the proportional solenoid valves mounted on the hydraulic manifold block. The electronic controller transfers the radio signals received from the transmitter into electronic commands to activate the hydraulic manifold system. Commands from the electronic controller activate the hydraulic manifold system.

Commands from the electronic controller activate the proportional solenoid valves allowing flow through the pilot servo hoses to activate the machine main control valve block.

The electronic controller also controls the machine engine. It receives signals from the operator through the hand held transmitter.

Commands can be transmitted to control functions such as: start/stop, slow/fast, R.P.M.+–, horn, on/off digital commands, emergency stop. The electronic controller also relays information and warnings to the hand held transmitter to inform or warn the operator. Examples of such messages: oil level low, oil pressure warning, temperature warning and system malfunctions The purpose build hydraulic manifold of the present invention houses any number, such as 20, proportional pressure reducing solenoid valves. The hydraulic manifold is connected to the hydraulic pilot system on the machine. The pilot pressure is connected to port "P" and the return connected to port "T Tank". Flow from the manifold through the hydraulic pilot servo lines connects to one inlet port of the shuttle valves, thus transmitting flow from the manifold to the machine's main hydraulic control block. Flow commences when the proportional valves receive commands from the electronic controller, the electronic controller having received its signal from the hand held radio transmitter activated by the operator.

The manifold is designed and built for this application having regard for the low system pressure and machine pilot system flow.

The shuttle valves has two inlet ports through which fluid flows into the valve, and one exit outlet port for the flow of fluid out of the valve. The shuttle valve has a valve member that shuttles or moves, such that flow through one of the inlet ports causes the valve member to more across and close off the other inlet port, the flow of fluid being directed out of the exit outlet port.

The mounting frame of the present invention uses a template provided so that holes may be drilled in mounting area to receive bolts and secure same in place.

The interface module comprising the electronic controller and hydraulic manifold block with proportional solenoid valves fitted is secured to the mounting frame. The manifold block is bolted to the mounting frame and the electronic controller is fitted to rubber mounts to reduce vibrations from shock during machine operation.

Hydraulic supply to the manifold block is connected by linking into machine servo pilot system and routing the pipe to a port on the manifold block. A return pipe is routed from the manifold block to the hydraulic tank and is connected to the existing return pipe work or supply line.

Hydraulic hoses connected to the hydraulic manifold are routed through the opening in the base of the mounting frame and through the corresponding hole in the machine bonnet or cover of the hydraulic machinery having been drilled with the aid of the template when fitting the mounting frame. These hydraulic hoses are routed to connect to the shuttle valves and are secured by clipping to existing hoses and brackets with the aid of cable ties.

To fit the present invention to a machine, individual pilot servo hoses from the in cab controls are identified and disconnected by removing their respective quick coupler from the plate and replacing with an identical quick coupler which in turn is connected to one of the inlet ports on a shuttle valve. The other port of the shuttle valve is connected to the hose coming from the remote manifold block for the corresponding function. The original pilot servo quick coupler having been removed earlier from the plate is connected to the outlet port of the shuttle valve port C thus completing the connection for a specific function of the hydraulic machinery. This process is replicated for all the functions until all hoses coming from the remote manifold block have been connected to their respective hoses to the main control block via the shuttle valves. As each shuttle valve is being fitted it is stowed away in the void under the cab through the front inspection cover.

Proportional solenoid valves are fitted to the hydraulic manifold. These valves receive variable voltage input from the electronic controller and can deliver variable hydraulic pressure output to the machine main control block. This type of control allows smooth stepless operation of the machine functions. Cartridge drop in type valves are used in this system to reduce system size and weight.

Aspects of the present invention have been described by way of example only and it should be appreciated that additions and/or modifications may be made thereto without departing from the scope thereof as defined in the appended claims.

The invention claimed is:

1. A control apparatus for hydraulic machinery having functions that are governed by the flow of hydraulic fluid through a hydraulic control block, wherein said hydraulic control block is controlled by a cab control system with a plurality of operator controls, said control apparatus comprising:

a remote control unit having actuators that correspond to at least some of said plurality of operator controls in said cab control system, wherein said remote control unit produces control signals when said actuators are utilized;

a valve arrangement for each of said actuators, wherein each valve arrangement includes a first valve means and a second valve means; and a controller that selectively opens and closes said first valve means in response to said control signals received from said remote control unit to control flow of said hydraulic fluid between said first valve means and said second valve means;

wherein, said first valve means and said second valve means for each said valve arrangement have a first configuration and a second configuration, said first configuration having said first valve means open to permit said hydraulic fluid to flow through said first valve means to said second valve means as said second valve means channels said hydraulic fluid received from said first valve means to said hydraulic control block to control at least one of said functions of said hydraulic machinery as directed by said control signals from said remote control unit, and a second configuration having said first valve means closed therein preventing said hydraulic fluid from flowing through said first valve means to said second valve means while enabling said hydraulic fluid to flow from said cab control system to said hydraulic control block to control said functions of said hydraulic machinery as directed by said plurality of operator controls of said cab control system.

2. The control apparatus according to claim 1, wherein said hydraulic fluid only flows from said first valve means and said cab control system to said second valve means at any given time.

3. The control apparatus according to claim 1, further including a hydraulic fluid holding tank, wherein each said first valve means is operable to receive said hydraulic fluid from said hydraulic fluid holding tank.

4. The control apparatus according to claim 1, wherein in each said valve arrangement said second valve means is connected to said first valve means and said cab control system of the hydraulic machinery.

5. The control apparatus according to claim 1, wherein said remote control unit is a hand-held portable device.

6. The control apparatus according to claim 1, wherein said remote control unit includes a radio frequency transmitter and said control signals are transmitted as radio frequency signals.

7. The control apparatus according to claim 1, wherein said controller converts said control signals from said remote control unit into valve control signals for controlling the opening and closing of said first valve means.

8. The control apparatus according to claim 1, wherein said first valves means for each said valve arrangement is housed within a hydraulic manifold block.

9. The control apparatus according to claim 8, wherein said hydraulic manifold block is supported on said hydraulic machinery.

10. The control apparatus according to claim 8, wherein said first valve means of each said valve arrangement includes a proportional solenoid valve.

11. The control apparatus according to claim 10, wherein said controller regulates flow of said hydraulic fluid through said proportional solenoid valve.

12. The control apparatus according to claim 8, wherein said controller is connected to said hydraulic manifold block, wherein said controller is mounted on a vibration absorbing means.

13. The control apparatus according to claim 1, further including a main hydraulic pump and a pilot pump, wherein said pilot pump is operable to pump said hydraulic fluid to said first valve means.

14. The control apparatus according to claim 1, wherein said second valve means is a shuttle valve with a first fluid inlet port, a second fluid inlet port, a pivoting valve member, and a fluid outlet port, wherein said first valve means and said cab control system are coupled to said first fluid inlet port and the second fluid inlet port, and said hydraulic control block is coupled to said fluid outlet port, wherein said hydraulic fluid flowing through one said first fluid inlet port and one said second fluid inlet port causes said pivoting valve member to pivot and close the other said first fluid inlet port and the other said second fluid inlet port so that said hydraulic fluid flows to said hydraulic control block from one of said first valve means and said cab control system at any given time.

15. The control apparatus according to claim 1, further comprising an interface harness operable to connect said control apparatus to said hydraulic machinery.

16. The control apparatus according to claim 15, wherein said hydraulic machinery has a power supply and said interface harness includes an electrical power supply cable operable to connect said controller to said power supply.

17. The control apparatus according to claim 15, wherein said interface harness further includes hydraulic fluid supply lines that connect and transfer said hydraulic fluid from said first valve means of each said valve arrangement to said second valve means of said valve arrangement.

18. The control apparatus according to claim 17, wherein said interface harness further includes hydraulic fluid supply lines that connect and transfer said hydraulic fluid from said cab control system to said second valve means of each said valve arrangement.

19. A method of fitting a control apparatus as claimed in claim 1, to hydraulic machinery, in which said second valve means is a shuttle valve having a first fluid inlet port, a second fluid inlet port, a pivoting valve member, and a fluid outlet port, said method comprising the steps of:

disconnecting a hose from said cab control system of said hydraulic machinery that controls a function of said hydraulic machinery, therein exposing a hose outlet on said cab control system;

connecting said hose outlet to one of: said first fluid inlet port and said second fluid inlet port of said shuttle valve;

connecting said first valve means to one of: said first fluid inlet port and said second fluid inlet port of said shuttle valve;

connecting said hose that was disconnected from said cab control system to said fluid outlet port of said shuttle valve, therein connecting said first valve means and said cab control system to said hydraulic control block via said shuttle valve.

20. The method of fitting a control apparatus according to claim 19, further comprising a step of:

repeating the steps performed in claim 19 for said plurality of functions of said hydraulic machinery.

* * * * *